US006735407B2

(12) United States Patent
Chavez et al.

(10) Patent No.: US 6,735,407 B2
(45) Date of Patent: May 11, 2004

(54) CORONA CHARGERS HAVING CONSUMER REPLACEABLE COMPONENTS

(75) Inventors: Jorge L. Chavez, Spencerport, NY (US); Graham S. Wright, Victor, NY (US); Joseph L. Baker, Rochester, NY (US); Vidanand P. Chand, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/263,983

(22) Filed: Oct. 3, 2002

(65) Prior Publication Data

US 2004/0047653 A1 Mar. 11, 2004

Related U.S. Application Data

(60) Provisional application No. 60/408,939, filed on Sep. 6, 2002.

(51) Int. Cl.[7] ..... G03G 15/02

(52) U.S. Cl. ..... 399/170; 399/172; 399/173

(58) Field of Search ..... 399/115, 168, 399/170, 171, 172, 173

(56) References Cited

U.S. PATENT DOCUMENTS

| | | | | |
|---|---|---|---|---|
| 5,485,253 A | | 1/1996 | Osbourne | |
| 5,909,608 A | * | 6/1999 | Manno et al. | 399/173 |
| 6,025,594 A | | 2/2000 | Bryce et al. | 250/324 |
| 6,038,120 A | | 3/2000 | May et al. | 361/227 |
| 6,144,826 A | | 11/2000 | Mitchell et al. | 399/170 |

* cited by examiner

*Primary Examiner*—Hoang Ngo

(57) ABSTRACT

A charging device assembly used within a reprographic machine having a hollow shell containing the charging device, an attachment mechanism that retains the charging device relative to the hollow shell in a predetermined position, a pair of end covers at either end of the hollow shell and an electrical connector on the shell coupled to the charging device. The hollow shell can be conductive or insulative and is formed with features that facilitate easy mounting and removing of the elements of the charging device assembly.

11 Claims, 8 Drawing Sheets

CORONA CHARGERS HAVING CONSUMER REPLACEABLE COMPONENTS

CROSS-REFERENCE TO RELATED APPLICATION

This application claims priority of the U.S. Provisional Application Serial No. 60/408,939, entitled, CORONA CHARGERS HAVING CONSUMER REPLACEABLE COMPONENTS, filed Sep. 6, 2002.

FIELD OF THE INVENTION

The present invention relates to corona charging devices, and more particularly to customer replacement components for corona chargers.

BACKGROUND OF THE INVENTION

There are numerous prior art disclosures detailing the use of charging devices within various types of reprographic machines, or printing devices, to control the polarity on various elements within the reprographic machine. Charging devices are especially useful in reprographic machines that employ electrostatics to control charge levels, condition image receiving elements as well as various parts of reprographic machines, and insure that charges are of the intended polarity. Corona chargers used within conventional reprographic machines typically require specially trained field service personnel to change the chargers after failure, or when their intended period of use is completed. In general, a corona charger is a high maintenance device, especially in high end printing devices that generate a high number of prints, and require qualified technicians or field service personnel to change the chargers. These high-end printing devices have particular actions items that need to be performed in a highly accurate manner. Actions such as dismounting the charger from the machine, removing covers on the machine or charger assembly, removing the wire used to for the corona charger, cleaning the charger body, putting back the assembly or covers, and mounting the chargers into the machine must be done in a manner that is essentially foolproof. In order to insure that proper maintenance is carried out on these high-end machines, specially trained personnel are typically required. The requirement of specially trained personnel can result in significant periods of downtime for the machine, which is an unacceptable loss for the owner/operator of a high-end printing device. To eliminate the need for specially trained personnel, a charger assembly is required that can quickly be replaced without requiring adjustments to be made.

In view of the foregoing discussion, there remains a need within the art for a device that allows the changing of charging devices by the owner/operator in short periods of time without the necessity of specially trained personnel. Additionally, there is a need for charging devices for high end printing machines that use interchangeable parts.

SUMMARY OF THE INVENTION

The present invention addresses the aforementioned needs within the prior art by providing a corona-charging device assembly that can quickly be replaced by the user/operator of a reprographic machine without requiring any adjustments in the charger assembly, resulting in significant increases in the up time exhibited by the reprographic machine. The up time is the amount of time that the machine is running and, therefore, available to produce high quality prints. Reprographic machines intended to produce large amounts of high quality prints are intended to have high reliability characteristics. The invention addresses these needs by providing a charger in the form of an operator replaceable component (ORC) for corona and web-charging devices.

The number of actions that the user/operator is required to perform and the difficulty of these actions are minimized by the charging device assembly structure of the present invention. There are certain actions that routinely need to be performed without the necessity of adjustments, and these actions need to be accomplished in a relatively foolproof manner. Actions such as dismounting the charger from the machine, removing any covers on the body, removing the wire corona, cleaning the charger body, putting the covers back on to the charger body, and mounting the chargers into the machine are critical to increasing the amount of up time of a reprographic machine.

The invention teaches a charging apparatus that can be used on a system having multiple charger assemblies. In the preferred embodiment, there are numerous web-charging assemblies including charging devices that tack down the receiver elements to the web, control potential levels between modules, detack the receiver elements from the web, and condition the web to be at a predetermined potential level. The invention provides a charging device that can readily be adapted to accomplish in an assembly that can be serviced by the user without requiring special tools.

The charger assembly of the invention provides every feature that is considered critical within a charging device mechanical assembly, and includes a single operator replaceable component (ORC). The mechanical assembly for the charging device includes the critical parts having the necessary measurements and adjustments already made to provide for the correct spatial configurations. These critical distances include the spacing between corona wires, ensuring equal distance between the web and the corona wires; the size of the gap between the wire and the ground plane or the charger grid, and the length of the corona wire among others.

In the preferred embodiment, the charger assembly is employed in a high-end digital printing device that uses charging devices to control potential levels throughout the system. High-end printing devices inherently use multiple charging devices and for high-end color, printing devices will require more charging devices. The mechanical assembly of the invention is used as an ORC for every charging device in the system, resulting in a more reliable reprographic machine.

The invention provides for sliding the charging device assemblies out of their operating positions within the digital printing device for performing actions that entail removal of the assembly. It should be noted that in performing the actions necessary to remove the charger assembly from the digital printing device, there is no need to remove any bracket or to unlock the charger. Additionally, the removal of a high voltage connector is invisible to the customer (blind mate HV connection). To disassemble the components of a charger, the front and rear covers have snap features that wrap around the end of the charger body and do not require the use of any tools. The removal of the corona wire is simplified by first removing the tension of the wire and then removing the wire form the assembly. The disassembly of the grid is accomplished by sliding the grid out from the charger body.

The invention has the advantage in that the same parts can be used in several charger applications. The same charger body can be used in the intermodule chargers, detack chargers, conditioner chargers without a grid, and conditioner chargers with a grid. The same rear covers can be used in all chargers bodies (intermodule, detack, and conditioners). The corona wires are the same in all chargers. Just one corona wire length can be used in numerous applications. The front end is the same in all chargers. The interchangeability of parts avoids confusion in inventory and reduces the number of parts that must be inventoried.

Additional advantages result from the ability to precisely locate the web between conditioner chargers and their associated grids.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
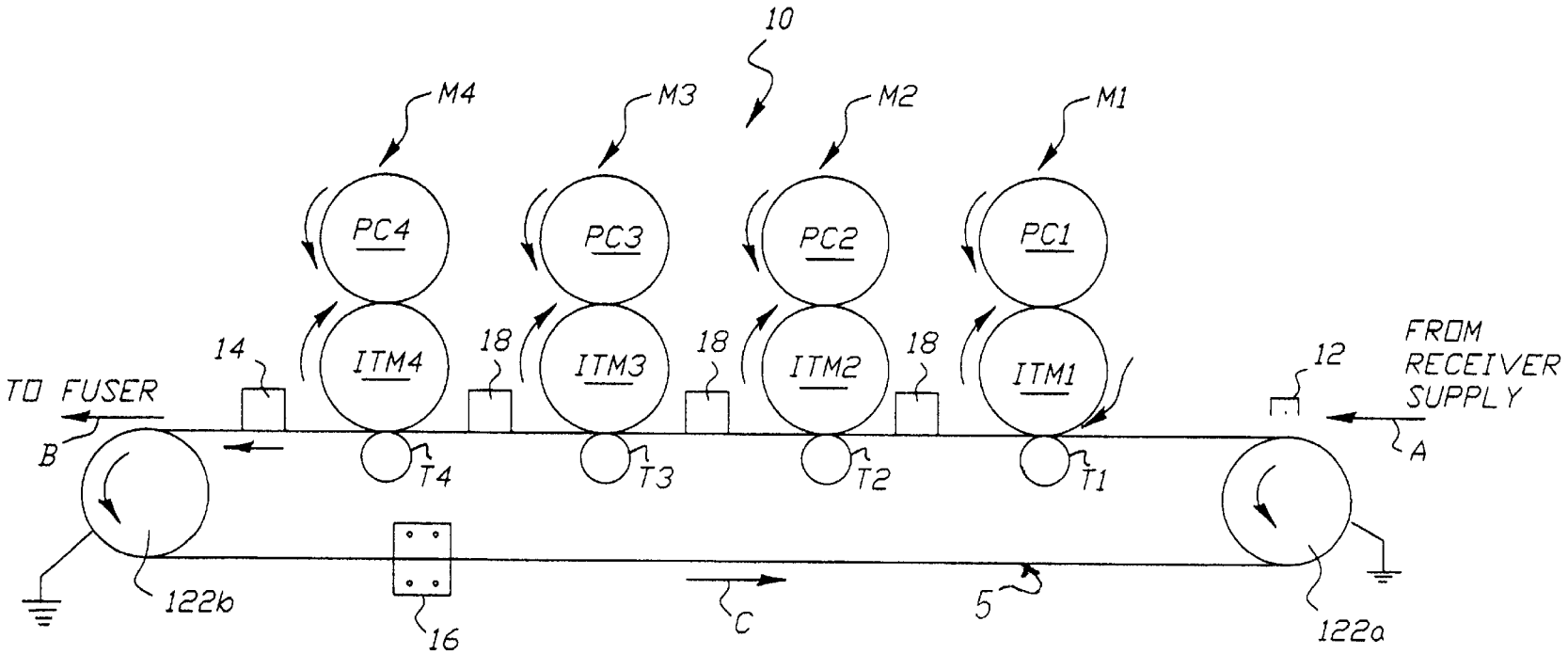
FIG. 1 is an illustration of a digital printer the employs the charging device assembly of the invention.

Referring to FIG. 1, the charger assembly of the invention is, for example, employed with a schematic representation of a multi-color digital printer 10 in multiple locations. The digital printer 10, preferably has four print modules M1, M2, M3, M4 each of which is responsible for printing a single color. Each of the modules M1, M2, M3, M4 has a photoconductive member, respectively indicated as P1, P2, P3, P4; an intermediate transfer member, respectively indicated as ITM1, ITM2, ITM3, ITM4; and a transfer roller respectfully indicated T1, T2, T3, T4. It will be readily understood, to those skilled in the art that the charger assembly of the invention can be used for different printer configurations that are too numerous to illustrate. The charger assembly of the invention includes a complete charging device that can be employed in multiple instances. Digital printer 10 contains various charger assemblies, of the present invention, that are placed at different areas within printer 10. The charging devices shown in FIG. 1 are the tackdown charger 12, detack charger 14, web conditioner charger 16, and intermodule chargers 18. The charging devices that are employed in the digital printer 10 will be either AC or DC based chargers. The tackdown charger is a DC charger while the detack, conditioner and intermodule chargers are AC based. The function of the tackdown charger 12 is to place a charge on the image receiver elements (sheets of paper for example) so that they adhere to the Web 5 and are transported therewith into association with the print modules. The function of the detack charger 14, within the preferred embodiment, is primarily to detach image receiver elements from the Web 5. Conditioner charger 16 operates on the Web 5, dependent upon the electrostatic properties of the Web, so that the Web is at a predetermined potential level before transporting a receiver element to the first print module M1. The function of the intermodule charger 18 is to compensate for the changes in potential levels resulting from the printing operations of each of the printing modules.

The charger assembly of the invention is intended to facilitate charger application maintenance and replacement, and allow the same parts to be used in several different charger applications. These applications are distributed around the printer 10, as described above. The spatial configurations for each of the corona wires in the various applications may not be the same. The capability of implementing ORC devices with multiple applications within a printing machine having interchangeable parts provides substantial advantages from the point of view of inventory management at the customer site. The number of spare parts that are required to be kept in inventory at a user location are minimized by employing a charger designs that use the same parts in the corresponding charger applications as described herein.

An advantage of the invention is the simplicity of the maintenance process for the chargers. The invention focuses on the maintenance process in terms of events the user needs to act upon, and the user response to these events without requiring (specialized) tools.

The tackdown charger 12 assembly includes a metal shell with end covers that contain a corona wire that is easy to remove. The corona wires employed are on the order of 0.005" and are intended to operate at 8 KV and 13 $\mu$A.

The detack charger 14 assembly is similar to that of the conditioner or intermodule charger 18 assembly with a plastic shell, a pair of end covers, and a replaceable corona wire. The corona wire is on the order of 0.005" and intended to accommodate 15 KVpp at 100 $\mu$A. The corona wire can be easy to remove and attached to a ground plane, which in the preferred embodiment, is a ski.

The conditioner charger 16 features numerous subassemblies that can be considered ORC devices. In the preferred embodiment there are four corona wires within the conditioner charger 16, each of the corona wires is on the order of about 0.127 (0.005") thick and operates at a potential of 15 KVpp drawing current of about 300–600 $\mu$A. The assemblies that house the corona wires within the conditioner charger 16 of the present invention, additionally, will employ plastic shells, end covers to prevent arcing, easy to remove corona wires, blind mate HV connector for the chargers, blind mate ground connector for grids, and slide in plastic extrusion elements. The conditioner charger 16 of the invention employs grids on predetermined corona wires within the conditioner charger 16. Most of the grids currently in the industry use a thin material (0.127 mm.) and apply tension to it. However, tension on the grid can result in flatness on the surface of the grid. Additionally, there are more parts added to the system by the tension mechanism. The preferred embodiment of the invention employs a grid that is just one part using 0.61 mm thick material, photoetched to the desired geometry and fastened to the charger body by snapping it on (as will be discussed further in greater detail) the shell. By the invention, the grid distance is tightly controlled by four tabs that are in reference to the corona wire location, as will be discussed in more detail below. The grid snaps around the four tabs by a cantilever beam member resulting in only a small deformation on the beam member, which is considered advantageous. After the first insertion of a grid onto a beam member, the grid does not present any substantial resistance force during insertion into the four tabs. The grid is considered an ORC which has a limited life because of contamination and other issues.

It should be noted that there are certain critical requirements for the conditioner charger 16. The location of the center of the Web between the chargers (preferably with grids) is considered critical and is controlled by the use of two skis. The skis allow the positional tolerance of chargers to be greatly reduced, and precisely locate the Web between chargers and grids. The only intention for the skis is to precisely locate the web between the chargers and grids. Once the skis are touching the web, the web path has been defined and the chargers are located in reference to the skis. The touching of the skis against the web can be loosely controlled and as long as the web touches the skis, the process is effective.

The intermodule charger 18 features a charger assembly that is an ORC in itself employing one 0.127 (0.005") corona wire capable of operating at about 15 KVpp, drawing current on the order of about 5–20 $\mu$ADC. The intermodule charger 18 has a plastic shell and end covers to prevent arcing.

Figure 2A:
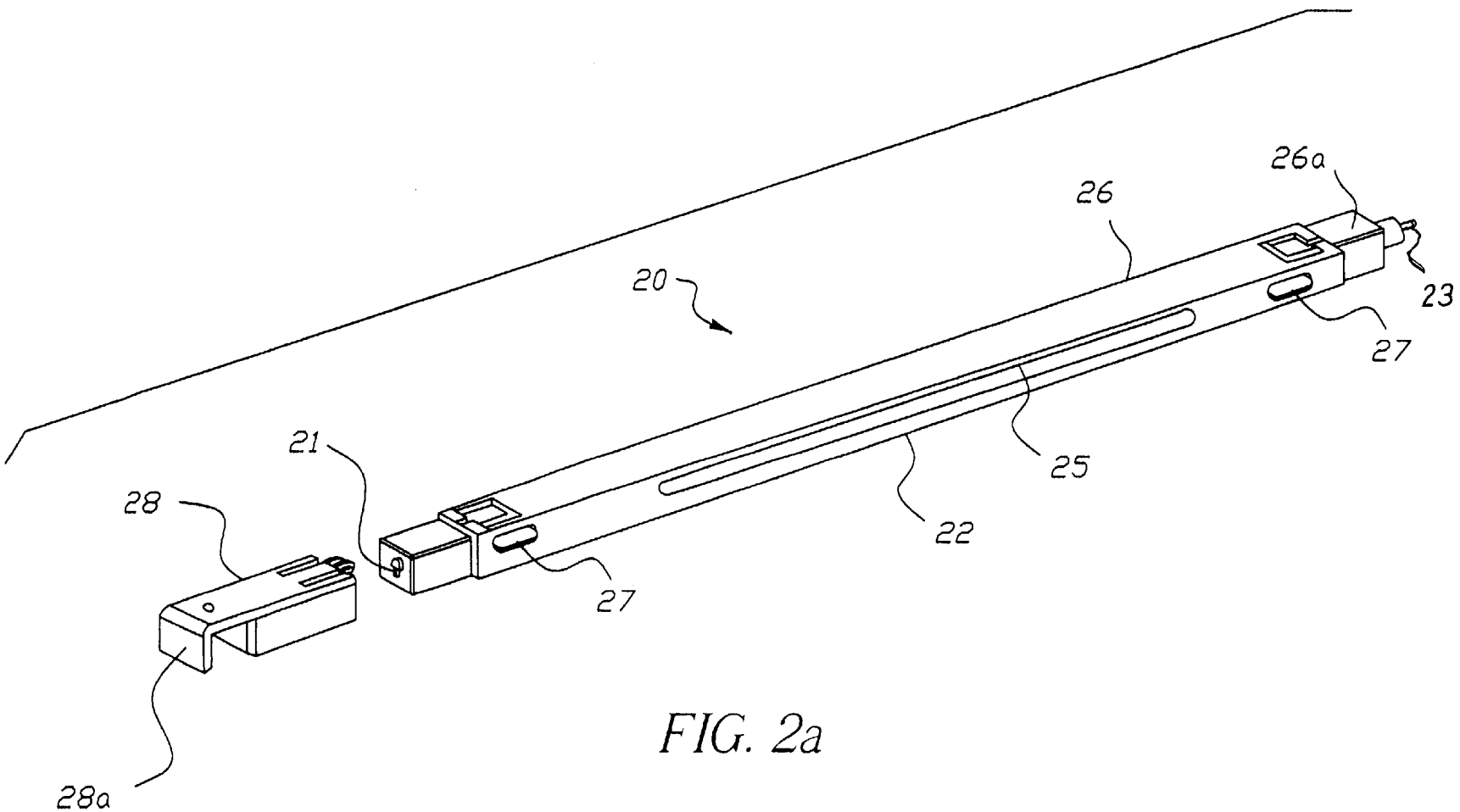
FIG. 2*a* is an exploded view of the topside of the charging device assembly of the invention.
Figure 2B:
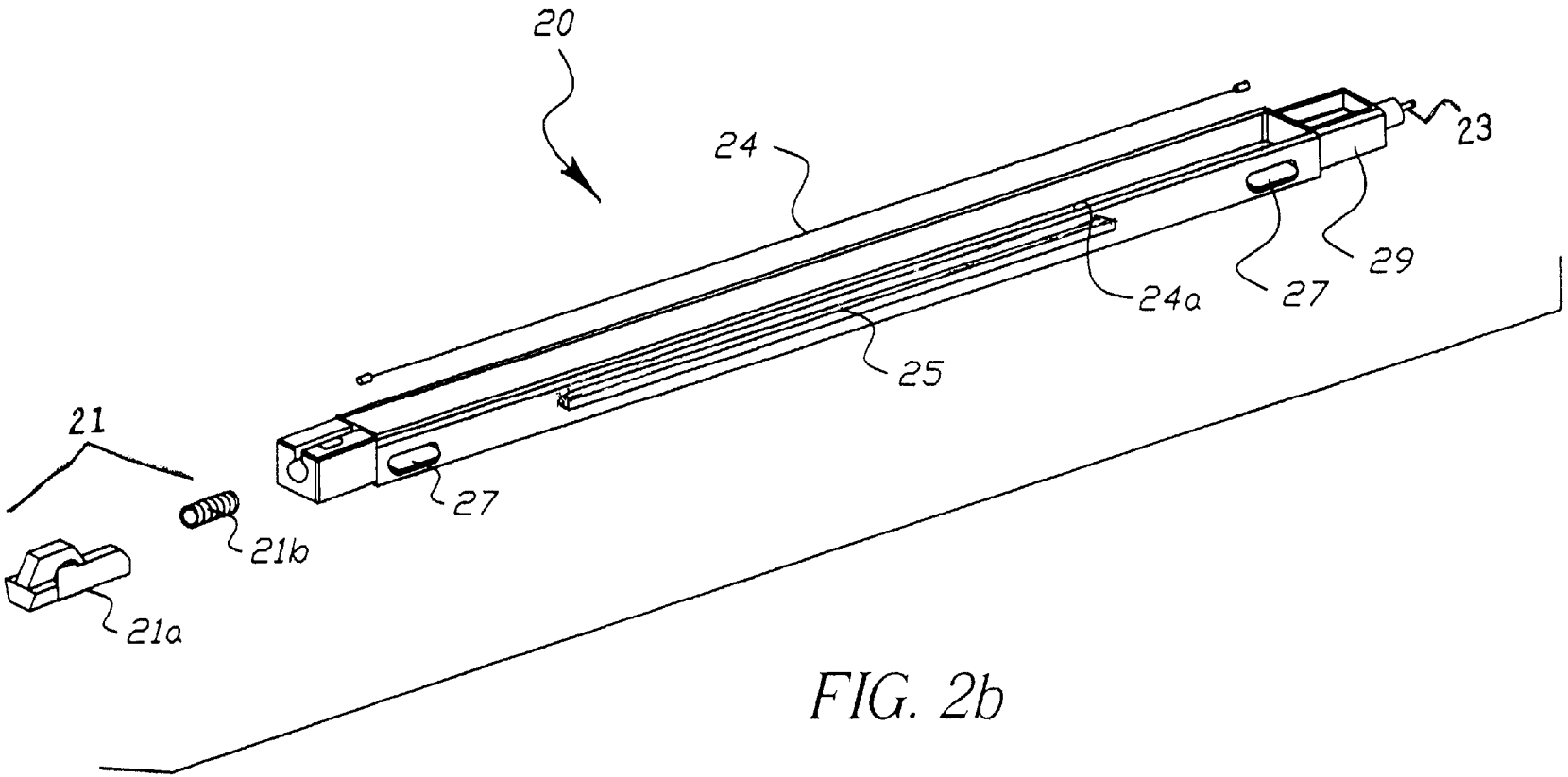
FIG. 2*b* is an exploded view of the bottom side of the charging device assembly of the invention.

FIG. 2*a* and FIG. 2*b* are partially exploded perspective views of the top and bottom sides, respectively, of the charger assembly 20 of the invention. FIG. 2*a* and FIG. 2*b* illustrate assemblies of chargers that are the AC type, however, DC type chargers will have essentially similar configurations differing mainly in materials. The charger assembly 20 includes outer hollow shell body 26 with front and rear covers 28, 29. As seen in FIG. 2*b*, charging device 24 (wire) is mounted within a hollow cavity 24*a*. The charging device 24 is secured into the shell body 26 by securing mechanism 21, preferably, plunger 21*a* acting against urging of spring 21*b*. The outer hollow shell body 26 for AC chargers is preferably made from an injection molded plastic material that is formed with side rails 25 and tabs 27 that are used to position and fasten the charger assembly 20 in its proper position within digital printer 10. The outer hollow shell body 26 is configured with AC Pin 23 as an electrical connector such that the charging device 24 is electrically coupled to AC Pin 23, which provides power to charging device 24 when plugged into a mating receptacle (not shown). Sub-assembly 22 includes the outer shell body 26 with the charging device 24 mounted, therein, such that it is coupled to AC Pin 23. The sub-assembly together with front and rear covers 28, 29 form much of the charger assembly 20. Additional items on charger assembly 20 will be discussed more below.

A pin at the end of the charger assembly (preferably straight out from the assembly body) couples the charging device to a high voltage source. Sliding the pin in connects to the high voltage receptacle, whereas sliding the pin out disconnects from the high voltage receptacle. Numerous types of couplings of high voltage source to the charging device are suitable for this invention, and it should be understood that the pin 23 is the preferred manner of applying high voltage to the charging device. The charging device 24 is a corona wire that is removed by depressing plunger 21*a* against urging of spring 21*b*.

The charger assembly 20 can be readily disassembled into its basic components. The front cover 28, rear cover 29 and outer hollow shell body 26 are preferably made of plastic that snap into place. The plastic front and rear covers 28, 29 include tabs 27 that snap into corresponding features (slots) on the body of the charger sub-assembly 22 by using the cantilever beam methodology wherein the plastic material of the tabs will flex with the application of a relatively small amount of force.

Figure 2C:
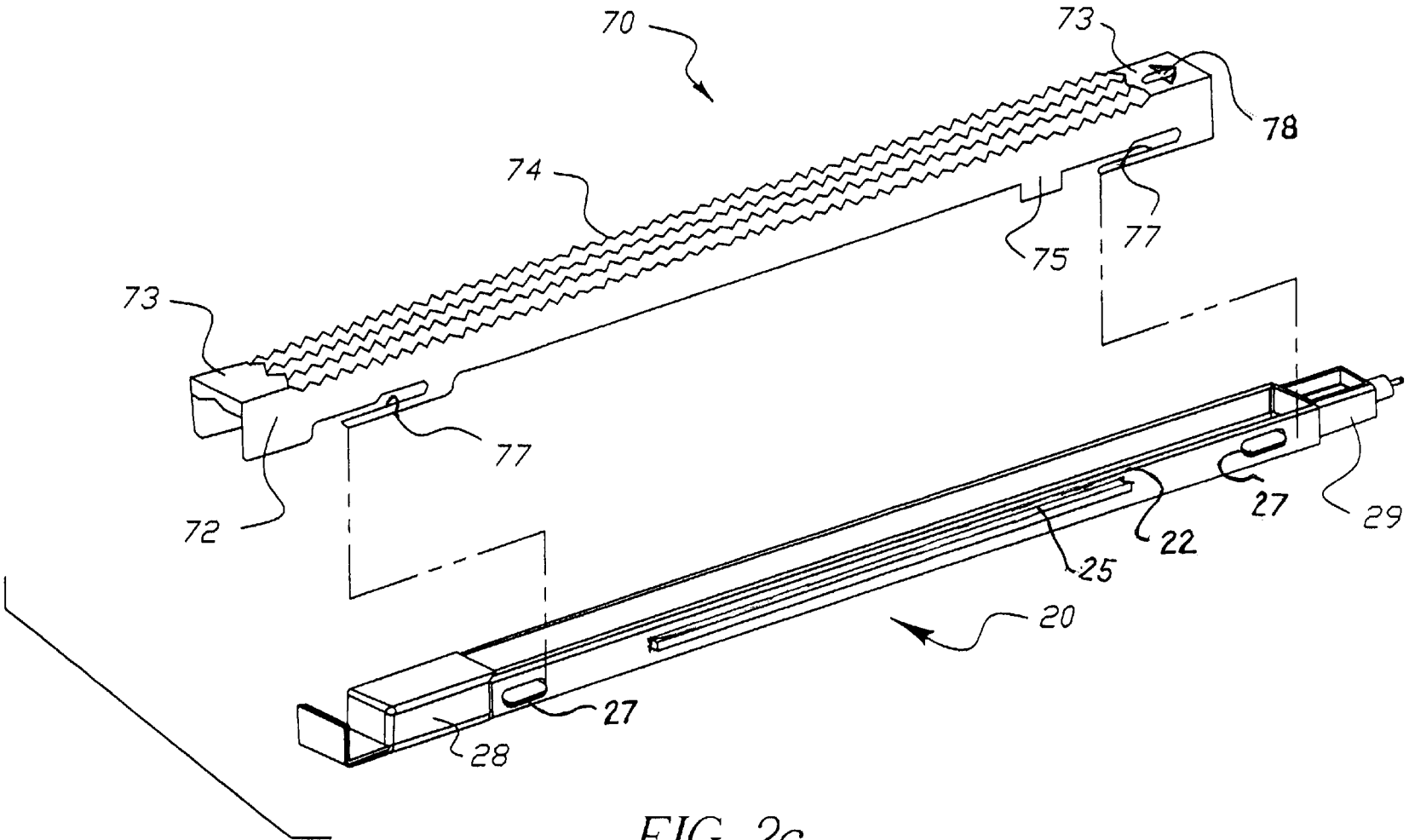
FIG. 2*c* is a view of the charging device assembly of the invention with a grid.

FIG. 2*c* illustrates a grid with the charger assembly that would be employed within the conditioner charger 16 as previously discussed. The grid 70 shown in FIG. 2*c* does not require tension; therefore, it does not suffer from the prior art problem of the surface of the grid. Also, fewer parts are required by the assembly shown if FIG. 2*c* than in prior art grid devices. The preferred embodiment employs a grid 70 that is formed as a single piece out of a conductive material that is approximately 0.61 mm thick. Preferably, the material used to make grid 70 is a steel alloy, or stainless steel. The preferred method of manufacturing the grid is by using conventional photo-etching processes to obtain the desired geometry. Steel based materials are preferred because these materials are conductive, photo-etch well and are not expensive. It will be readily apparent that other materials can be used. Also, other manufacturing processes can be used to form grid 70, and these other processes will be readily apparent to those skilled in the art. During the manufacturing process, features are formed with the grid 70. Among the features that are formed on grid 70 are those features that assist in fastening the grid 70 to the charger device assembly 20 and enable the grid 70 to be simply snapped into place on the charger device assembly. The grid 70 snaps around the four tabs 27 by four slots 77 formed within the sidewalls of the grid 70 such that tabs 27 can be inserted into slots 77. The invention enables a tight control of the distances associated with grid 70 because the four tabs 27 provide a reference to location of the corona wire. To remove the grid 70 from the sub-assembly 22 a force in exerted in a direction to disengage slots 77 from tabs 27. Slots 77 are fashioned to engage tabs 27 and secure grid 70 to the charger device assembly 20 in a removable manner. The assembly illustrated in FIG. 2*c* does not result in the exertion of a large tensile force on the cantilever beam structure of sub-assembly 22. The structure of grid 70 can itself be viewed as a beam. An advantage of the assembly shown in FIG. 2*c* is that the lack of tension required results in only a small deformation on the beam structure of sub-assembly 22. The grid 70 needs to be able to lie flat, within a plane, once placed on the sub-assembly. The grid 70 by itself removed from the plane can be either rigid or flexible. Once a grid 70 has been inserted-on the charger device assembly 20, the four tabs 27 easily slide into slots 77 and the grid itself will fit onto the sub-assembly 22. The assembled charger can then be inserted into an appropriate one of the mouriting devices (e.g., frame 80, or support structure 110) without any resistance from the grid 70 during insertion. The grid 70 is considered an ORC which has a limited life because contamination and other issues. Thus, the ability to remove grid 70 and replace or clean it is an important feature towards keeping the printer 10 up and running producing high quality prints. The grid 70 members include both a gridded portion 74 and a non-gridded portion 73 that are formed in such a manner that, preferably, the length of the gridded portion 74 will be long enough to extend beyond the boundary area between the end caps 28, 29 with sub-assembly 22 when the grid 70 is placed in position on the charger assembly 20 thereby leaving a gridded area above this boundary. The grid includes an arrow shaped cut out 78 for reference in guiding the completed assembly into the intended supporting structure. Once assembled, the side wall 72 of grid 70 will overlap the side wall of the charger device assembly 20 in such a manner that the features formed on the side wall 72 of grid 70 surrounds and almost touch the side rail 25 of charger device assembly 20.

Figure 2D:
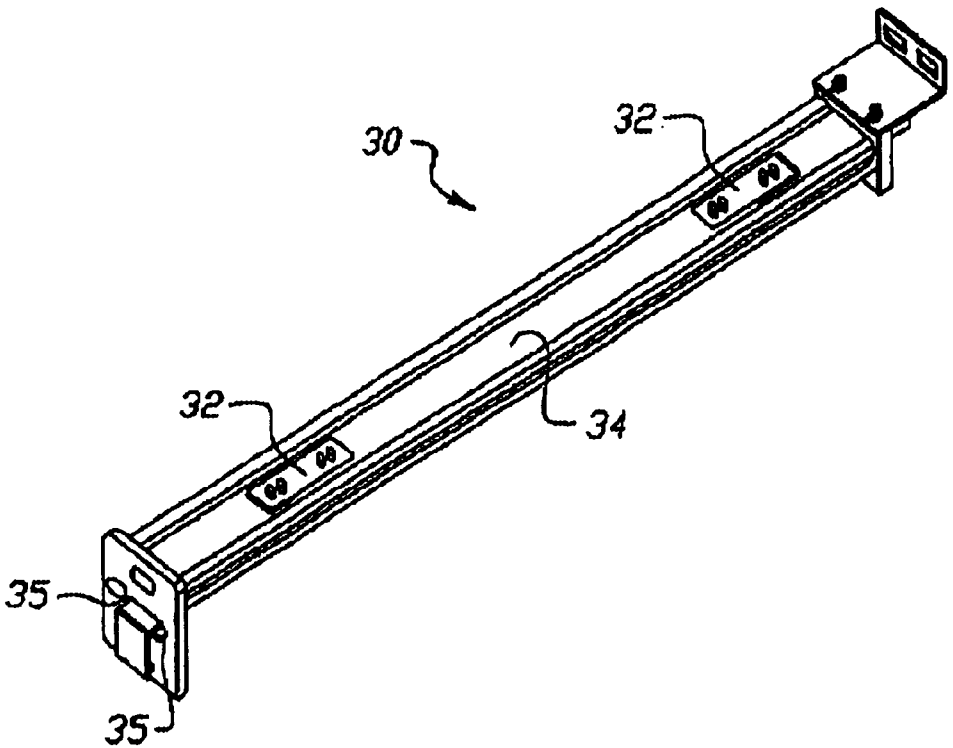
FIG. 2*d* is a view of a mounting device that can be used with the charging device assembly of the invention.

FIG. 2*d* illustrates an exploded view of a typical charger support frame 30. The procedure for dismounting the charger assembly 20 from printer 10 is a simplified procedure allowing the operator to perform the task of removing and replacing the charging device 24. The charger assembly 20 with charging device 24 (preferably a corona wire) rests within the outer hollow shell body 26 that provides an enclosure for charging device 24. The charger assembly 20 is placed into the charger support frame 30 such that the charger assembly 20 is urged against the charger support frame 30. The charger assembly 20 is placed into rail 34 such that side rails 25 (see FIG. 2*b*) fitting within rail slots 35, can slide into position. The preferred embodiment uses mechanical urging forces to press the charger assembly 20 against one side of the charger support frame 30 by placing at least one flat plate spring assembly 32 on the charger assembly 20. As seen in FIG. 2*d,* one spring assembly 32 is shown towards the back of rail 34, and preferably, another spring assembly is located towards the front of rail 34. As previously discussed, there are four tabs 27 on the sub-assembly 22 that fit inside the rail slots 35 of rail 34 to position the charging device 24 within the charger support frame 30. Each push spring assembly 32 creates a mechanical force that presses the four tabs 27 against the bottom of rail slots 35 of rail 34, thus providing the desired positioning of the charging device 24 within the charger support frame 30. The mechanical urging provided by push spring assembly 32 guarantees that the charging device 24 is located in the same position every time the charger assembly 20 is moved in and out of the charge support frame 30. The mechanical urging force provided by the push spring assemblies 32 is sufficient to insure that charging device 24 is located in the desired position during operation of printer 10, but is small enough so that removal of the charger assembly 20 by the operator is accomplished by simply pulling on handle portion 28*a* (see FIG. 2*c*) of charger assembly 20. The operator needs only to pull on the handle portion 28*a* of front cover 28 to remove the charger assembly 20 from the charger support frame 30.

Figure 2E:
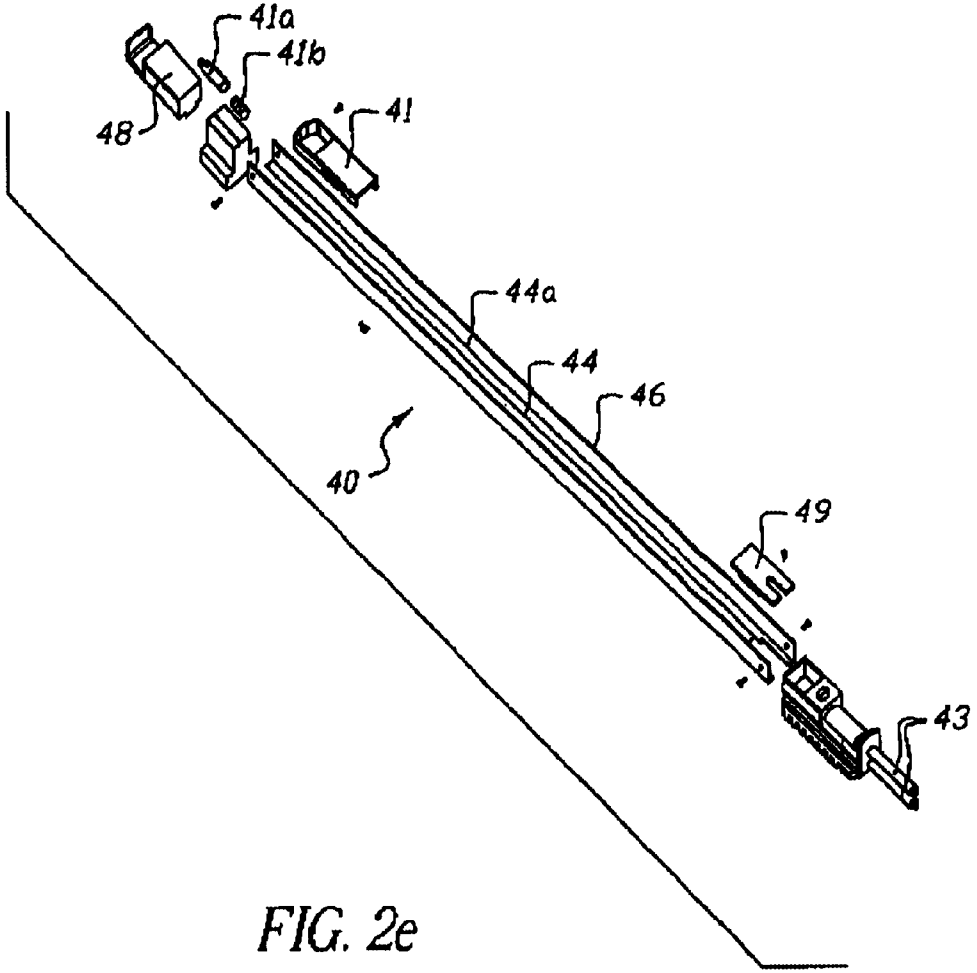
FIG. 2*e* is an exploded view of an alternate charging device assembly of the invention.

FIG. 2*e* is a partially exploded perspective view of charger assembly 40 of the invention. FIG. 2*e* illustrates an assembly of a DC type charger that has a similar configuration to the chargers shown in FIG. 2*a* and FIG. 2*b,* differing essentially only in materials. The charger assembly 40 includes outer hollow shell body 46 with front and rear covers 48, 49. Charging device 44 is mounted within a hollow cavity 44*a* of body 46. The charging device 44 is secured into the shell body 46 by securing mechanism 41; preferably, plunger 41*a* and spring 41*b* are used as elements of the securing mechanism 41. The outer hollow shell body 46 for DC chargers is preferably made from a conductive material, such as metal, that is a more rigid material than used to form the hollow shell body to the AC chargers previously discussed. Outer hollow shell body 46 may be formed with side rails and tabs (similar to those elements as described above) that are used to position and fasten the charger assembly 40 in its proper position within digital printer 10. The outer hollow shell body 46 is configured with DC Pins 43 coupled to charging device 44 to provide power to charging device 44 when plugged into a mating receptacle (not shown). Sub-assembly includes the outer hollow shell body 46 with the charging device 44 mounted, therein, such that it is coupled to DC Pins 43. The sub-assembly together with front and rear covers 48, 49 form much of the charger assembly 40. Additional items on charger assembly 40 will be discussed more below.

A pin at the end of the charger assembly (preferably straight out from the assembly body) couples to the charging device to a high voltage source. Sliding the pin in connects to the high voltage receptacle, whereas sliding the pin out disconnects from the high voltage receptacle. Numerous types of couplings of high voltage source to the charging device are suitable for the invention, but it should be understood that the pin is the preferred manner of applying high voltage to the charging device. The charging device 44 is a corona wire that is removed by depressing the plunger 41*a*.

Figure 2F:
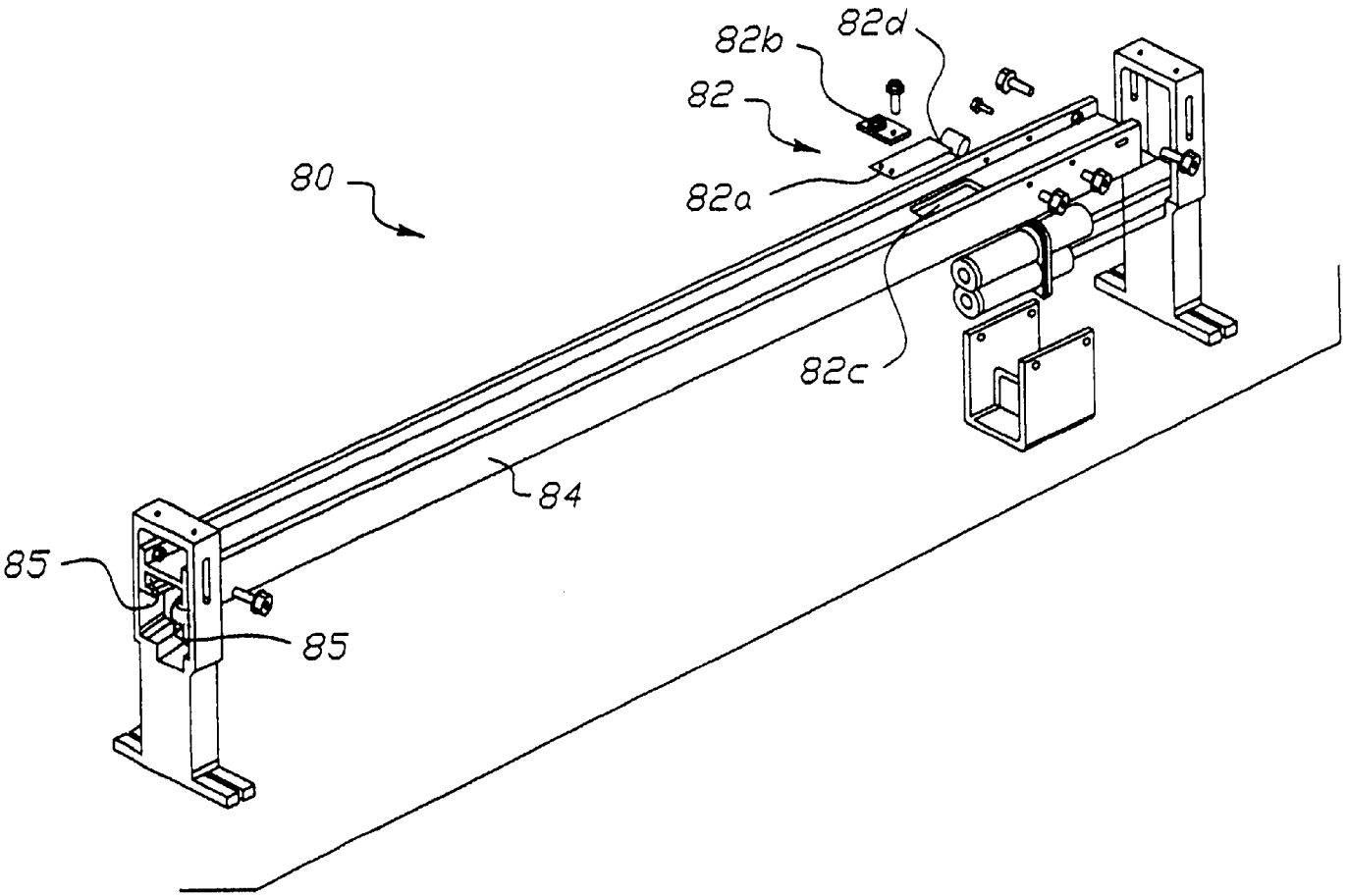
FIG. 2*f* is a view of an alternate mounting device that can be used with the charging device assembly of the invention.

FIG. 2*f* illustrates a typical charger support frame 80 for use with charger assembly 40. The procedure for dismounting the charger assembly 40 from printer 10 is a simplified procedure for allowing the operator to perform the task of removing and replacing the charging device 44. The charger assembly 40 with charging device 44 (preferably a corona wire) rests within the outer hollow shell body 46 that provides an enclosure for charging device 44. The charger assembly 40 is placed into the charger support frame 80 such that the charger assembly 40 is urged against charger support frame 80. The charger assembly 40 is placed into rail 84 such that side rails fit within rail slots 85 and slide into position. The preferred embodiment uses mechanical urging forces to press the charger assembly 40 against one side of the charger support frame 80 by placing at least one flat plate spring assembly 82 for acting on the charger assembly 40. As seen in FIG. 2*f,* one spring assembly 82 is shown towards the back of rail 84. The push spring assembly 82 creates a mechanical force that presses the charger assembly against the rail slots 85 of rail 84, thus providing the desired positioning of the charging device 44 within the charger support frame 80. The push spring assembly 82 includes a flat-plate spring 82*a* and spacer 82*b* that are mounted on rail 84 and engage indentations within the outer hollow shell body 46. Aperture 82*c* is provided in rail 84 so that bent portion 82*d* protrudes through aperture 82*c*. The side rails of a charger assembly (for example, charger assembly 20) can then be slid along rail slots 85 of rails 84 and allow bent portion 82*d* of flat-spring 82*a* to engage indentation 26*a* (see FIG. 2*b*). The mechanical urging provided by spring assembly 82 guarantees that the charging device is placed in the same position in the printer 10 every time the charger assembly is removed and returned to the charge support frame 80. The mechanical urging force provided by the spring assembly 82 is sufficient to insure that charging device is located in the desired position during operation of printer 10, but small enough so that removal of the charger assembly by the operator is accomplished by simply pulling on the handle portion of the charger assembly. The operator needs only to pull on the handle portion of the front cover to remove the charger assembly from the charger support frame 80.

Figure 3:
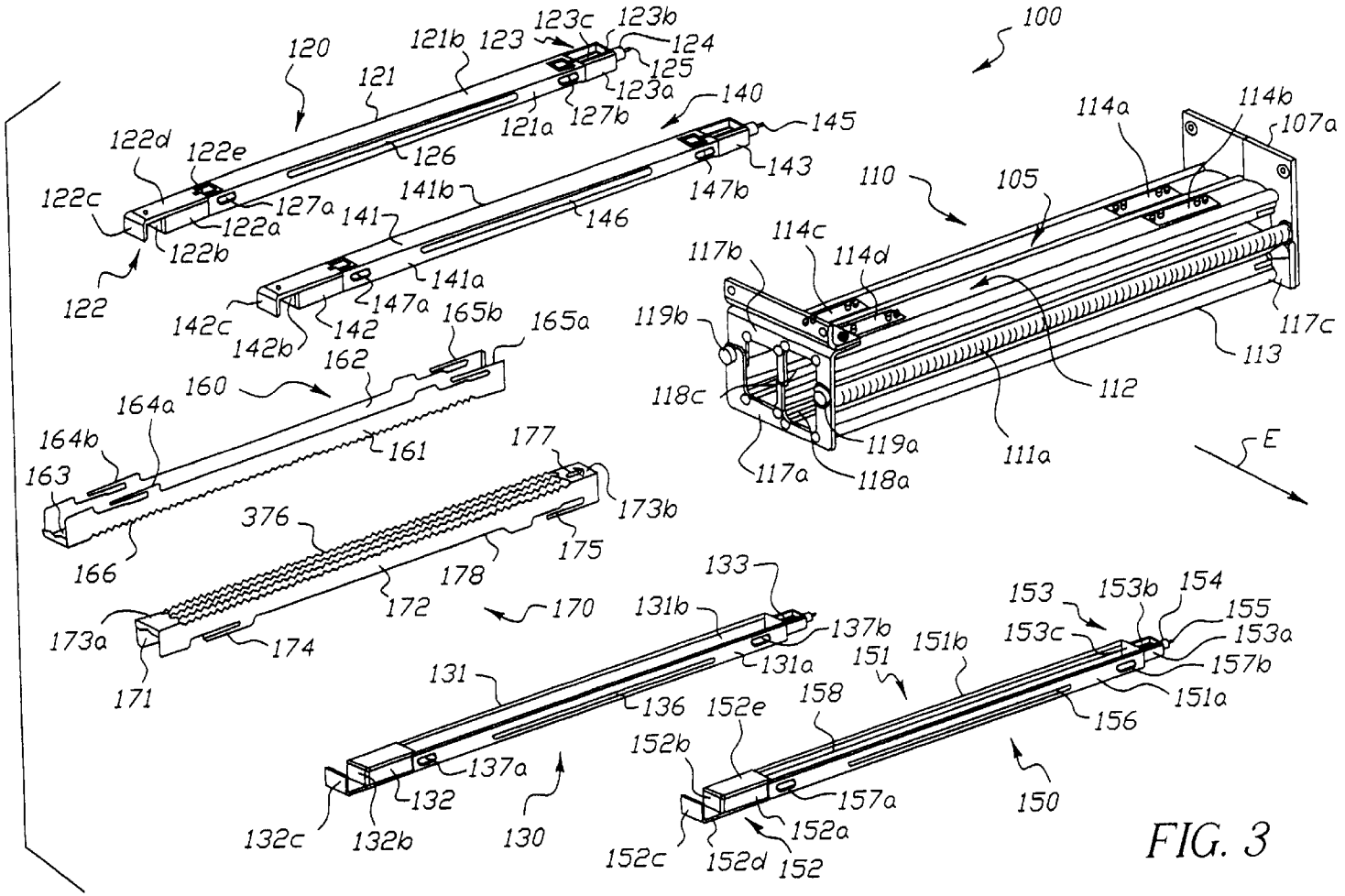
FIG. 3 is a view of a conditioning charger using four charging device assemblies of the invention, two of the assemblies using grids.

FIG. 3 is an exploded view showing a web conditioning charging station (element 16 in FIG. 1), employing charging device assemblies, according to the invention. The charging stations generally designated as 100 in FIG. 3, has a supporting structure 110 and charging device assemblies 120, 130, 140, and 150. Charging device assemblies 120 and 130 are first stage corona chargers. Charging device assemblies 140 and 150 are second stage corona chargers. In the second stage, the charging device assemblies 140, 150 are respectively associated with grid members 160, 170. The charging device assemblies 120, 130, 140, and 150 are made to be substantially the same as one another in accordance with the modular concepts of the invention. Accordingly, grid members 160 and 170 are also made to be substantially the same, within manufacturing tolerances. During operation of the digital printer 10, the transport web passes through supporting structure 110 in a direction indicated by arrow E.

The charging device assemblies 120, 130, 140, 150 have respective hollow shells 121, 131, 141, 151 with respective sidewalls 121*a*, 131*a*, 141*a*, 151*a* and respective walls 121*b*, 131*b*, 141*b*, 151*b*. Charging device assemblies 120, 130, 140, 150 have removable end caps 122, 132, 142, 152, which cover the respective end walls (not shown) of the operative portion of the hollow shell 121, 131, 141, 151. Removable end caps 122, 132, 142, 152 are preferably made out of an insulative material. The end caps 122, 132, 142, 152 include: side walls 122*a*, 132*a*, 142*a*, 152*a*; end walls 122*b*, 132*b* 142*b*, 152*b*; and handles 122*c*, 132*c*, 142*c*, 152*c* which provide for mounting and removing charging device assemblies 120, 130, 140, 150 within supporting structure 110. Insulative end caps 123, 133, 143, 153 cover the respective other ends (not shown) of charging device assemblies 120, 130, 140, 150. Each of the insulative end caps 123, 133, 143, 153 is preferably molded as a single piece that is made to be removable from their respective shell 121, 131, 141, 151.

Charging device assembly 150 is seen in a bottom side view as including a charging device (corona wire 158) traversing the length of the open portion of charging device assembly 150. As can be seen, the interior of charging device assembly 150 is hollow, with the open portion of charging device assembly 150 defined by removable end cap 152, and insulative end cap 153 covering a second end wall (not visible) of shell 151. Wall 152*e* of end cap 152 of charging device assembly 150 covers a portion (not visible) of the corona wire 158 which is held under tension by a spring loaded mechanism (not illustrated), the spring loaded mechanism also being covered by wall 152*e*. Such structure is substantially similar for the other charging device assemblies. End cap 153 includes sidewalls 153*a* and 153*c*, and a wall 153*b* that covers the other end of wire 158, which end of the wire is attached to a metal pin 155. The pin 155 is surrounded by an insulative coating 154, which insulative coating is molded to the corresponding end wall (not visible) of shell 151. Pin 155 and coating 154 pass with clearance through a hole in the end wall of end cap 153 (end wall and hole not visible). The corona wire 158 has a preferred diameter of 0.0033 inches, and is preferably made of tungsten. The shells, e.g., shell 121, are preferably made of Mindel B-430 plastic. Shell side walls, 151*a*, and 151*b* are about 2 mm thick, and shell back walls, e.g., back-wall 121*b*, are about 2 mm thick. The end caps 122, 123 are preferably made of flame retardant PET sold under the trade name Valox 310SEO. Connector pin 125 is preferably made of a brass alloy. Other suitable materials can be substituted to make the shells, end caps, corona wires, or pins as will be readily apparent to those skilled in the art.

Charging device assembly 120 is shown in top and side view illustrating insulative end cap 123 and a top piece 122*d* which includes a spring portion 122*e*. The spring portion 122*e* snaps into a shallow outer recess in wall 121*b* (recess not illustrated) for purpose of attaching end cap 122 to shell 121. By lifting spring portion 122*e*, end cap 122 can be removed. End cap 123, which is similar to end cap 153, includes a sidewall 123*a* and a top piece 123*b*, which includes a spring portion 123*c*. The spring portion 123*c* snaps into a shallow outer recess in wall 121*b* (recess not illustrated) for purpose of attaching end cap 123 to shell 121. By lifting spring portion 123*c*, end cap 123 may be removed. Pin 125 and pin coating 124 pass with clearance through a hole in the end wall of end cap 123 (end wall and hole not visible). Each of charging device assemblies 120, 130, 140, and 150 is thus similarly provided with a dielectric shell, a tensioned corona wire, and two insulative end caps covering the ends of each corona wire. The opening between end caps defines the operational charging length of each such corona wire. The operational charging length of each of these corona wires is approximately 366.5 mm, but may be any suitable length as desired.

Each of charging device assemblies 120, 130, 140, 150 is provided with symmetrically located side rails 126, 136, 146, 156, one side rail on the outer face of each side wall. The side rails 126, 136, 146, 156 are used for the purpose of mounting and dismounting the charging device assemblies 120, 130, 140, 150 within the supporting structure 110 and are preferably molded as portions of the shell during shell manufacture.

The charging device assemblies 120, 130, 140, 150 are also provided with tabs on an outer surface. The tabs are generally designated by reference numerals 127*a*, 127*b*, respectively for the front and rear areas of charging device assembly 120. In a similar manner tabs 137*a*, 137*b* are provided for the front and rear areas of charging device assembly 130; tabs 147*a*, 147*b* are provided for charging device assembly 140; and tabs 157*a*, 157*b* are provided for charging device assembly 150. The tabs are preferably molded as part of the shell during the manufacturing process such that they exist on both sides of the front and rear of the respective shell and mate with slots or apertures that are found within a mounting mechanism for the charging device assemblies. The tabs serve the dual functions of facilitating mounting/dismounting the charging device assemblies from the supporting structure 110 and providing a mechanism for attaching grid members to the charging device assemblies if desired. Within the web conditioning charging station 100, the second stage preferably employs grids that are removeably secured to the second stage charging device assembly 140 by clips 164*a* and 165*a* which respectively mate with tabs 147*a*, 147*b*. In a similar manner, clips 174, 175 on grid member 170 removeably secure the grid members to tabs 157*a*, 157*b* on second stage charging device assembly 150.

The grid members 160, 170 include both a gridded portion and a non-gridded portion such that the gridded portions will lie above the end caps when the grid member is in position on the charging device. The grid members are preferably made of stainless steel. Each grid member preferably has a cut out that assists in guiding the charging device assemblies 140, 150 in the second stage into the supporting structure 110. With the second stage chargers assembled, the sidewalls of the grid members overlap the sidewalls of the shells to a considerable extent. Thus, side wall 172 of grid member 170 overlaps side wall 151*a* of the shell of charging device 150, with the lower edge portion of side wall 172 almost touching side rail 156 (similar for the corresponding lower edge portion not visible, of side wall 171). During operation of the second stage charger assemblies with the grid members grounded, the overlapping sidewalls of the grid members provide advantages by acting to enhance the efficiency of the charger assemblies.

Supporting structure 110 includes two end plates (one at either end) to provide support for support elements 105, 106, 112, 113. End plates 117*a*, 117*b* are at a first end, and end plates 107*a*, 117*c* are at a second end to provide support for extruded elements 105, 106, 112, 113. The extruded support elements 105, 106, 112, 113 are manufactured to be essentially identical. Preferably, support elements 105, 106, 112, 113 are made from a metal such as extruded aluminum. Support elements 105, 106, 112, 113 are held in place in end plates 117*b* and 107*a*. End plates 117*a* and 117*b* are preferably made of a metal material, such as stainless steel. End plates 107*a* and 117*c* are preferably made of a hard material, preferably an insulating plastic or dielectric polymeric material. The interior lengths of the support elements 105, 106, 112, 113 have sidewalls containing longitudinal tracks for purpose of supporting charging device assemblies. The charging device assemblies 120,130, 140, 150 are supported in the tracks of supporting structure 110 by respective rails and tabs sliding in the pairs of longitudinal tracks included in support elements 105, 106, 112, 113.

The four extruded support elements 105, 106, 112, 113 each includes two steel leaf spring members for holding their respective charging device assemblies 120,130, 140, 150 securely in place within support member 110. Thus element 105 includes spring members 114*a* and 114*c*, and element 112 includes spring members 114*b* and 114*d*. The spring members are preferably fastened by screws however, it will be readily apparent to those skilled in the relevant art that other fastening devices such as rivets, bolts or adhesives could be used in place of screws.

The end plates 107*a* and 117*c* are preferably made of a strong, electrically insulating material. Their inner surfaces are at least partially coated with a conductive screening material in order to reduce electromagnetic interference (EMI) from the corona charger high voltage wires. Preferably, end plates 107*a* and 117*c* are made of a flame retardant polyphenylene oxide sold under the tradename Noryl EN 185. To provide partial coatings of conductive screening material on the inner surfaces of these end plates, a copper foil tape, sold under the tradename CHO-FOIL, available from the Chomerics Corporation, may be applied. Most of the inner surface of each end plate is covered by the conductive tape in such manner as to avoid electrical contact or shorting to high voltage components, the conductive portions of the tape being preferably grounded. Alternatively, the conductive EMI shielding may be applied to the end plates 107*a* and 117*c* by other suitable means, such as, by vacuum evaporation, or conductive ink, or any other conventional manner of providing thin coatings.

The extruded aluminum support elements 105, 106, 112, 113 are electrically grounded, as are grid members 160, 170. Each of the grid members 160 and 170 is grounded, within the preferred embodiment, via metal spring clips embedded between the longitudinal tracks, such as tracks 118*a* and 118*c* of the second stage support elements (metal spring clips not illustrated).

A downstream constraint ski member 111*a* is included in supporting structure 110 for the purpose of controlling and positioning the transport web through web conditioning charging station 100. A similar upstream constraint ski member (not shown), is also used in conjunction with downstream constraint ski member 111*a* to control the web position. The constraint ski members provide tension on the transport web (see FIG. 1), as it passes through web conditioning charging station 100, enabling a more efficient charge to be placed on the web by charging device assemblies 120,130, 140, 150. The constraint ski members are preferably made of highly polished stainless steel cylindrically shaped rods that are permanently attached at both ends to end plates 117*b* and 107*a*.

The supporting structure 110 includes an upper section and a lower section joined, for example by thumbscrews 119*a, b*. The upper section of supporting structure 110 includes the end plates 117*b* and 107*a*, the first stage support element 105, the second stage support element 112, as well as the downstream ski member 111*a* and its upstream counterpart. The lower section includes end plates 117*a* and 117*c*, as well as the second stage support element 113 and its first stage counterpart (not shown). Removal of thumbscrews 119*a, b* allows the entire lower section of supporting structure 110 to be slid off and separated from the upper section. The separation of the upper and lower sections of supporting structure 110 can be accomplished with or without the first and second stage chargers in place. The removal of the lower section of supporting structure 110 provides access to the transport web, such as when it is necessary to replace a worn or damaged web. Therefore, it is not necessary to disturb upper section of supporting structure 110 during the installation of a new transport web and the entire conditioning charging station 100 is restored to a proper operating position, quickly and easily while maintaining high reliability. The charging device assemblies 120, 130, 140, 150 can be in place during disassembly of supporting structure 110. If desired the charging device assemblies 120, 130, 140, 150 can be easily removed by simply pulling on the respective handle portions.

As illustrated by FIG. 3, the preferred web conditioning charging station 100 of the invention embodies fixed spacing between each of the first and second stage chargers and between the chargers and either side of the transport web passing through the web conditioning charging station. Moreover, the preferred web conditioning charging station also has predetermined, accurate, fixed spacing between the two corona wires included in the first-stage chargers, as well as predetermined, accurate, fixed spacing between the two grids of the grid members included in the second-stage chargers. However, the as-manufactured wire-to-wire separation provided in the first stage is typically optimized for a given speed of motion of the transport web, and different as-manufactured wire-to-wire separations may be appropriate for different web speeds. Similarly, the as-manufactured grid-to-grid separation provided in the second stage is typically optimized for a given speed of motion of the transport web, and different as-manufactured grid-to-grid separations may be appropriate for different web speeds. Thus, web conditioning charging stations may be manufactured with differing fixed geometries for different web speeds.

Moreover, although not included in the web conditioning charging station 100 illustrated in FIG. 3 one or more mechanisms (not illustrated) may alternatively be provided for allowing adjustment of the first stage and/or second stage spacing without requiring removal of the web conditioning charging station from the printer 10. Such mechanisms may include, for example, screw devices with verniers such as micrometers.

The foregoing description details the embodiments most preferred by the inventors to which variations will be readily apparent to those skilled in the art, accordingly, the scope of the invention should be measured by the appended claims.

| Parts List | |
|---|---|
| 10 | printer |
| 12 | tackdown charger |
| 14 | detack charger |

-continued

| Parts List | |
|---|---|
| 16 | conditioner charger |
| 18 | intermodule charger |
| 20 | charger assembly |
| 21 | securing mechanism |
| 21a | plunger |
| 21b | spring |
| 22 | sub-assembly |
| 23 | AC pin |
| 24 | charging device |
| 25 | side rails |
| 26 | outer hollow shell body |
| 26a | indentation |
| 27 | tabs |
| 28 | front cover |
| 28a | handle portion |
| 29 | rear cover |
| 30 | charger frame |
| 32 | plate spring assemblies |
| 34 | rail |
| 35 | rail slots |
| 40 | charger assembly |
| 41 | securing mechanism |
| 42 | sub-assembly |
| 43 | DC pins |
| 44 | charging device |
| 45 | side rails |
| 46 | outer hollow shell body |
| 48 | front cover |
| 49 | rear cover |
| 70 | grid |
| 80 | charger frame |
| 82 | push spring assemblies |
| 82a | flat springs |
| 82b | spacer |
| 82c | aperture |
| 82d | bent portion |
| 84 | rail |
| 85 | rail slots |
| 105 | support element |
| 106 | support element |
| 107a | end plate |
| 110 | supporting structure |
| 111 | ski member |
| 111a | constraint ski member |
| 112 | support element |
| 113 | support element |
| 117c | end plate |
| 118a | track |
| 118c | track |
| 119a | thumb screw |
| 119b | thumb screw |
| 120 | charging device assembly |
| 121 | shell |
| 121a | side-wall |
| 122 | end cap |
| 122a | side wall |
| 122b | end wall |
| 122c | handle |
| 123 | end cap |
| 126 | side rails |
| 127a | tab |
| 127b | tab |
| 130 | charging device assembly |
| 131 | shell |
| 131a | side-wall |
| 132 | end cap |
| 132a | side wall |
| 132b | end wall |
| 132c | handle |
| 133 | end cap |
| 136 | side rail |
| 137a | tab |
| 137b | tab |
| 140 | charging device assembly |
| 141 | shell |
| 141a | side-wall |
| 142 | end cap |

-continued

| Parts List | |
|---|---|
| 142a | side wall |
| 142b | end wall |
| 142c | handle |
| 143 | end cap |
| 146 | side rail |
| 147a | tab |
| 147b | tab |
| 150 | charging device assembly |
| 151 | shell |
| 151a | side-wall |
| 151b | side-wall |
| 152 | end cap |
| 152a | side wall |
| 152b | end wall |
| 152c | handle |
| 153 | end cap |
| 153a | side wall |
| 153b | wall |
| 153c | side wall |
| 155 | pin |
| 156 | side rail |
| 157a | tab |
| 157b | tab |
| 158 | wire |
| 160 | grid member |
| 170 | grid member |
| 171 | side wall |
| 172 | side wall |
| 173 | area |
| 174 | clip |
| 175 | clip |
| 177 | cut out |

What is claimed is:

1. A charging device assembly to be placed into a mount and used within a reprographic machine, said charging device assembly comprising:

a hollow shell having retaining features;

a charging device having retaining features cooperating with retaining features of said hollow shell so as to retain said charging device relative to said hollow shell in a predetermined position without separate fasteners or tools;

at least one end cover that mates with said hollow shell and is retained thereby without separate fasteners or tools; and an electrical connector electrically coupled to said charging device.

2. The charging device assembly of claim 1, wherein said hollow shell is an insulative material.

3. The charging device assembly of claim 2, wherein said insulative material is a plastic.

4. The charging device assembly of claim 1, wherein said hollow shell is a conductive material.

5. The charging device assembly of claim 4, wherein said conductive material is extruded aluminum.

6. The charging device assembly of claim 1, further including a grid member having retaining features cooperating with retaining features of said hollow shell so as to retain said grid member relative to said hollow shell in a predetermined position without separate fasteners.

7. The charging device assembly of claim 1, further including a pair of end covers, each of said end covers mating respectively with an opposite end of said hollow shell.

8. The charging device assembly of claim 1, wherein certain of said retaining features of said hollow shell support said charging device within the mount.

9. The charging device assembly of claim 8, wherein said certain of said retaining features for supporting said hollow shell within the mount further includes at least one rail formed on said hollow shell that allows said assembly to slide relative to the mount.

10. The charging device assembly of claim 9, wherein said retaining features of said hollow shell include a plurality of tabs that provide location assistance of said hollow shell within the mount.

11. A charging device assembly of modular configuration and a support, for use at various locations in a reproduction apparatus, comprising:

a) a hollow shell having retaining features;

b) a charging device having retaining features cooperating with retaining features of said hollow shell so as to retain said charging device relative to said hollow shell in a predetermined position without separate fasteners or tools;

c) at least one end cover that mates with said hollow shell and is retained thereby without separate fasteners or tools;

d) a grid member having retaining features cooperating with retaining features of said hollow shell so as to retain said grid member relative to said hollow shell in a predetermined position without separate fasteners;

e) an electrical connector electrically coupled to said charging device; and a plurality of mounts at a plurality of locations, respectively, about said reproduction apparatus, each of said mounts selectively supporting said modular charging device including at least elements a)–c) and e), and element d) if required at a selected one of said plurality of locations.

* * * * *